US005669646A

United States Patent [19]

Fiocca et al.

[11] Patent Number: 5,669,646

[45] Date of Patent: Sep. 23, 1997

[54] DEVICE FOR POSITIONING AND RETRIEVING GOLF BALLS AND TEES

[75] Inventors: Emmanuel R. Fiocca, 1233 Agnew Dr., Drexel Hill, Pa. 19026; Bruce G. Greenfield, 9 Fieldstone La., Bryn Mawr, Pa. 19010

[73] Assignees: Emmanuel R. Fiocca, Drexel Hill; Bruce G. Greenfield, Bryn Mawr, both of Pa.

[21] Appl. No.: 748,253

[22] Filed: Nov. 12, 1996

[51] Int. Cl.[6] ..... A63B 47/02; A63B 57/00

[52] U.S. Cl. ..... 294/24; 294/19.2; 473/386

[58] Field of Search ..... 294/19.1, 19.2, 294/24, 115; 473/132, 133, 386

[56] References Cited

U.S. PATENT DOCUMENTS

| | | | |
|---|---|---|---|
| 683,244 | 9/1901 | Boda et al. . | |
| 824,642 | 6/1906 | Gibbs . | |
| 919,731 | 4/1909 | La May . | |
| 925,212 | 6/1909 | McConville . | |
| 1,175,035 | 3/1916 | Wooster | 294/19.2 X |
| 1,254,765 | 1/1918 | Binn . | |
| 1,331,499 | 2/1920 | Hartford . | |
| 1,452,679 | 4/1923 | Fisher | 294/19.2 |
| 1,852,956 | 4/1932 | Czichos | 294/19.2 X |
| 1,863,140 | 6/1932 | Mulvaney . | |
| 1,902,682 | 3/1933 | Walrath | 473/386 |
| 1,948,284 | 2/1934 | Breitbarth | 273/33 |
| 2,326,676 | 8/1943 | Peters | 294/11 |
| 2,609,198 | 9/1952 | Armstrong | 294/19.2 X |
| 2,642,796 | 6/1953 | La Bore . | |
| 2,759,758 | 8/1956 | Yancey | 294/19.1 X |
| 2,834,629 | 5/1958 | Williams | 294/19.2 |
| 2,943,856 | 7/1960 | Eimerman | 294/19.2 X |
| 3,186,593 | 6/1965 | Miotke | 294/19.2 X |
| 3,206,197 | 9/1965 | Miotke | 273/33 |
| 3,904,200 | 9/1975 | Jackle et al. | 273/33 |
| 4,013,295 | 3/1977 | Baughman | 294/19.2 X |
| 4,231,603 | 11/1980 | van Zelm | 294/19.1 |
| 4,466,650 | 8/1984 | Roedel | 294/19.2 |
| 4,526,369 | 7/1985 | Phelps | 294/19.2 X |
| 4,589,661 | 5/1986 | Attig | 273/32.5 |
| 4,616,826 | 10/1986 | Trefts | 294/19.2 X |
| 4,629,234 | 12/1986 | Sokolowski | 294/19.1 |
| 4,693,473 | 9/1987 | Miller | 294/19.2 X |
| 4,714,250 | 12/1987 | Henthorn | 294/19.2 X |
| 4,761,026 | 8/1988 | Warden et al. | 294/19.2 |
| 4,819,938 | 4/1989 | Hill | 294/19.2 X |
| 4,949,961 | 8/1990 | Milano | 294/19.2 X |
| 4,951,947 | 8/1990 | Kopfle | 273/32.5 |
| 4,969,646 | 11/1990 | Tobias | 273/32.5 |
| 5,037,150 | 8/1991 | Vecchi | 294/19.2 |
| 5,080,357 | 1/1992 | Wolf | 294/19.2 X |
| 5,165,744 | 11/1992 | Vogrin | 294/19.2 |
| 5,171,010 | 12/1992 | Lanoue | 273/32.5 |
| 5,205,598 | 4/1993 | Miller | 294/19.2 |
| 5,330,177 | 7/1994 | Rogge | 294/19.2 X |
| 5,330,178 | 7/1994 | Geishert, Sr. | 273/32.5 |
| 5,439,213 | 8/1995 | Pimentel | 273/32.5 |
| 5,540,432 | 7/1996 | Keller | 473/386 |

*Primary Examiner*—Johnny D. Cherry

*Attorney, Agent, or Firm*—Seidel, Gonda, Lavorgna & Monaco, PC

[57] ABSTRACT

The present invention relates to a golf ball and tee positioning device which includes a gripper disposed at one end of an elongated shaft for manipulating golf balls and a tee inserter disposed at the other end of the shaft for inserting a tee into the ground. The tee inserter includes a rod extending from the shaft, a barrel slideably disposed on the rod, and a pair of spring biased jaws pivotably attached to the barrel. Each jaw member has a mandible portion which extends into a slot formed in the barrel for engaging a tee located within the barrel. The tee is inserted into the ground by placing the tee inserter against the ground and pressing the rod into the barrel so that it engages the head of the tee. This forces the tee past the spring biased jaws, setting the tee into the ground.

15 Claims, 4 Drawing Sheets

8
72
80
66
82
64
18
82
108
14
8
3
114
28
22
3
10
12
4
49
20
16
38
40
40
34
4

72
66
18
82
82
64
108
114
14
22
10
12
49
20
16
38
40
40
34

FIG. 12
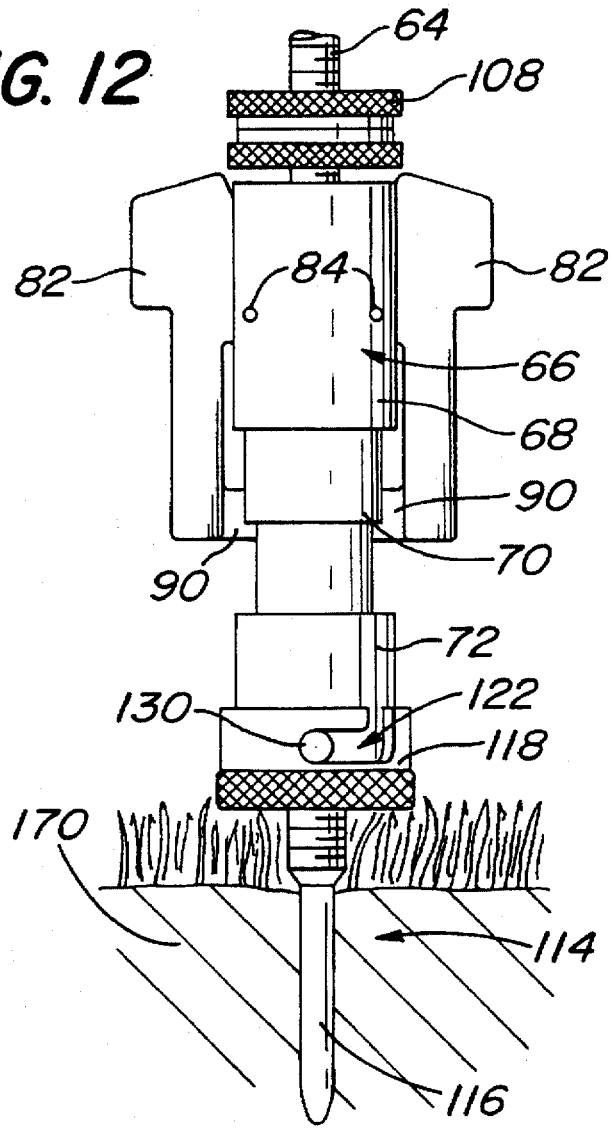
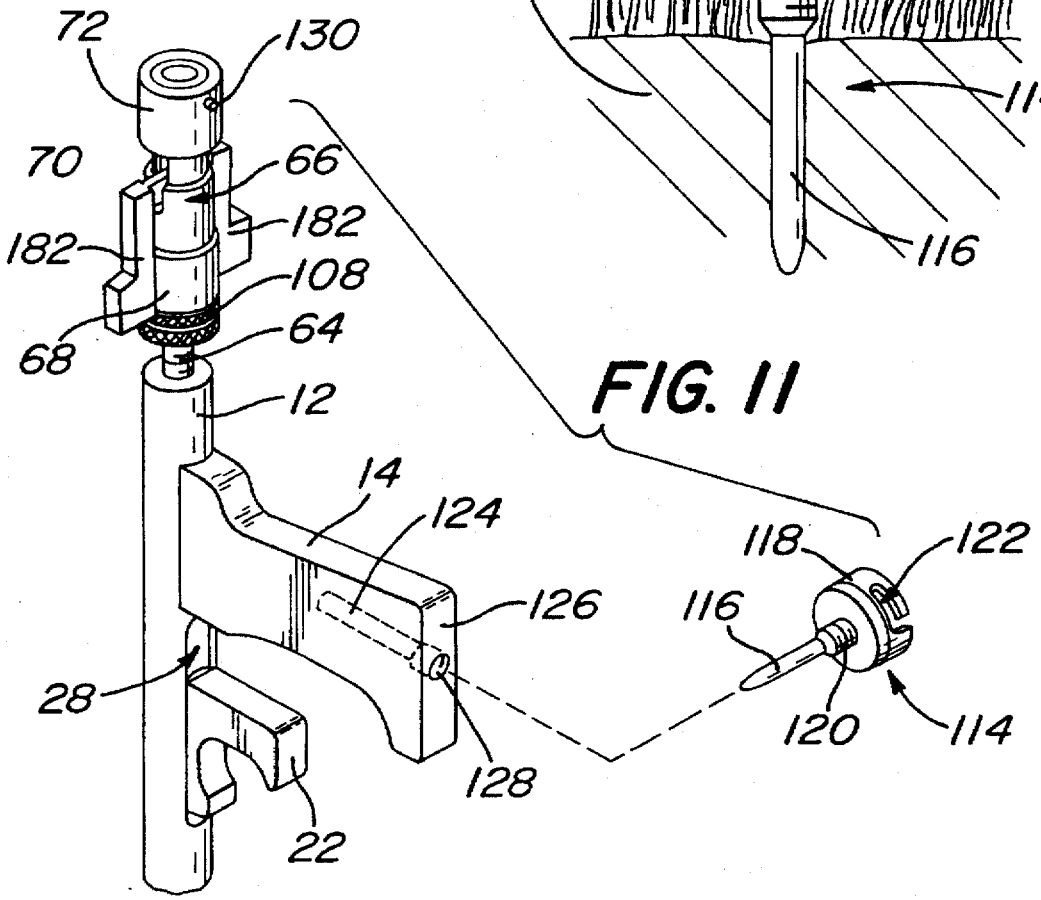
FIG. 11

DEVICE FOR POSITIONING AND RETRIEVING GOLF BALLS AND TEES

BACKGROUND OF THE INVENTION

The invention relates generally to the manipulation of golf balls and tees, such as in preparation for driving the ball from the tee. In particular, the invention concerns providing a lightweight, portable device used to insert a golf tee into the ground and to position a golf ball on the tee, such that the ball is at the height desired by the golfer without requiring the golfer to bend or stoop.

SUMMARY OF THE INVENTION

The present invention relates to a golf ball and tee positioning device which includes a gripper disposed at one end of an elongated shaft for manipulating golf balls and a tee inserter disposed at the other end of the shaft for inserting a tee into the ground. The tee inserter includes a rod extending from the shaft, a barrel slideably disposed on the rod, and a pair of spring biased jaws pivotably attached to the barrel. Each jaw member has a mandible portion which extends into a slot formed in the barrel for engaging a tee located within the barrel. The tee is inserted into the ground by putting a tee into the barrel, placing the tee inserter against the ground, and pressing the rod into the barrel so that it engages the head of the tee. This forces the tee past the spring biased jaws, setting the tee into the ground.

The golf ball and tee positioning device can also include a selectively-positionable stroke-adjusting knob disposed on the elongated rod which coacts with an end wall of the barrel to limit the stroke of the rod for controlling the depth of insertion of a tee.

It is also contemplated that the gripping device include an actuating rod slideably disposed within the shaft, an actuator connected to the shaft for displacing the actuating rod axially within the shaft, and a pair of gripping jaws pivotably mounted to a bracket disposed on the end of the actuating rod for grasping a spherical object, such as a golf ball. In addition, pivotably mounted control arms can also be provided which connect each gripping jaw member to a support bracket on the shaft such that displacing the actuating rod causes the gripping jaws to pivot between opened and closed positions.

The invention can also include a pistol-type grip mounted to the shaft with a trigger-type actuator disposed in proximity to the grip so that a user can hold the device by the grip and simultaneously operate the trigger with the same hand.

It is also contemplated that a spike be provided which is replaceably mounted on the tee inserter for forming pilot-tee holes in hard or frozen ground and for supporting the device in the ground while playing.

Additional features and advantages of the invention will become apparent to those skilled in the art upon consideration of the following detailed description of the preferred embodiment exemplifying the best mode of carrying out the invention as presently perceived. The detailed description particularly refers to the accompanying drawings.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 11 is an exploded view of the tee inserter end of the device of FIG. 1; and FIG. 12 is an enlarged side view of device of FIG. 1 showing the tee inserter with the spike attachment thereon in use.

DETAILED DESCRIPTION OF THE PREFERRED EMBODIMENT

Figure 1:
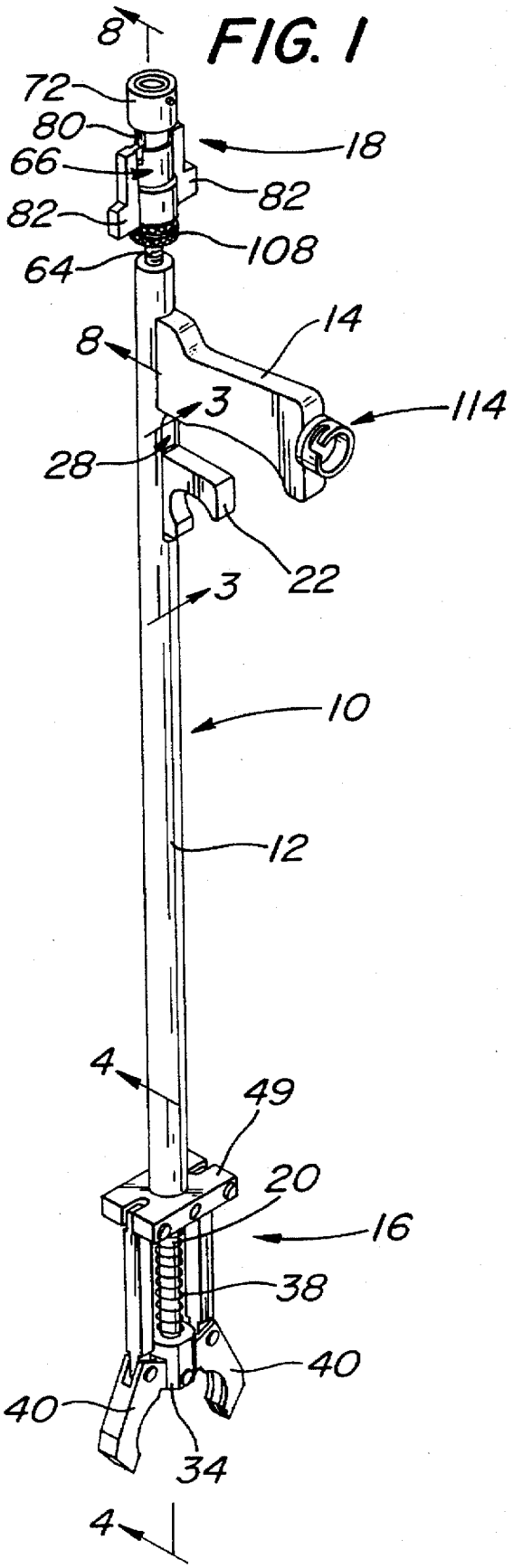
FIG. 1 is a perspective view of the device of the present invention.
Figure 2:
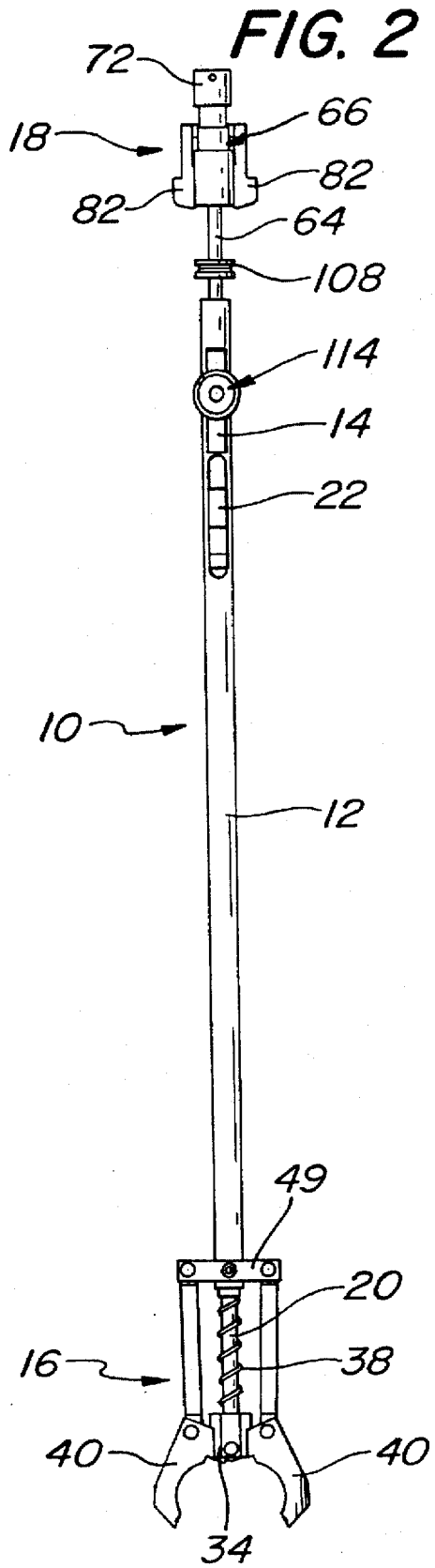
FIG. 2 is a bottom plan view of the device of FIG. 1.

Referring now to the drawings, FIGS. 1 and 2 illustrate an embodiment of the invention in the form of a device 10 for automatically inserting golf tees into the ground and for positioning a golf ball so that it can be placed on the tee, without requiring a golfer to bend at the waist or stoop.

The device 10 includes an elongated tubular shaft 12 having a pistol-type grip 14 rigidly connected to the tubular shaft 12 and transversely extending therefrom. A gripper 16 for positioning and retrieving golf bails and tees is disposed on one end of the tubular shaft 12 and a tee inserter 18 for inserting tees into the ground is disposed on the other end of the tubular shaft 12.

The tubular shaft 12 is hollow and has a coaxial inner rod 20 slideably housed within the tubular shaft 12. The inner rod 20 is connected to the gripper 16. A trigger actuator 22 is located near the grip 14 and operates the inner rod 20 to open and close the jaws of the gripper 16, as described in greater detail below.

Figure 3:
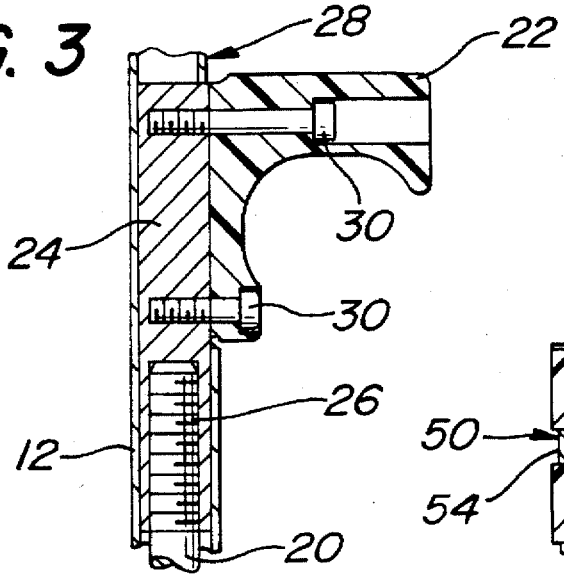
FIG. 3 is a cross-sectional view of the device taken along line 3—3 of FIG. 1.

Referring now to FIG. 3, a cylindrical slide member 24 is attached to the end of the inner rod 20. The slide member 24 maintains the inner rod 20 spaced from the inner walls of the tubular shaft 12 in a coaxial orientation. The slide member 24 is fixedly attached to the inner rod 20 by any suitable connection, such as the threaded connection 26 shown.

An opening 28 is formed in the circumferential wall of the tubular shaft 12 in the vicinity of the slide member 24, such that the slide member 24 is exposed through the opening 28. The trigger actuator 22 is fixedly attached to the slide member 24 through the opening 28 in the tubular shaft 12, such as, for example, by means of threaded fasteners 30. It should be understood, however, that any fastener which is capable of fixedly securing the trigger actuator 22 to the slide member 24 can also be used. Displacing the trigger actuator 22 within the confines of the opening 28 serves to slideably displace the slide member 24 and, thus, the inner rod 20 within the tubular shaft 12.

Figure 4:
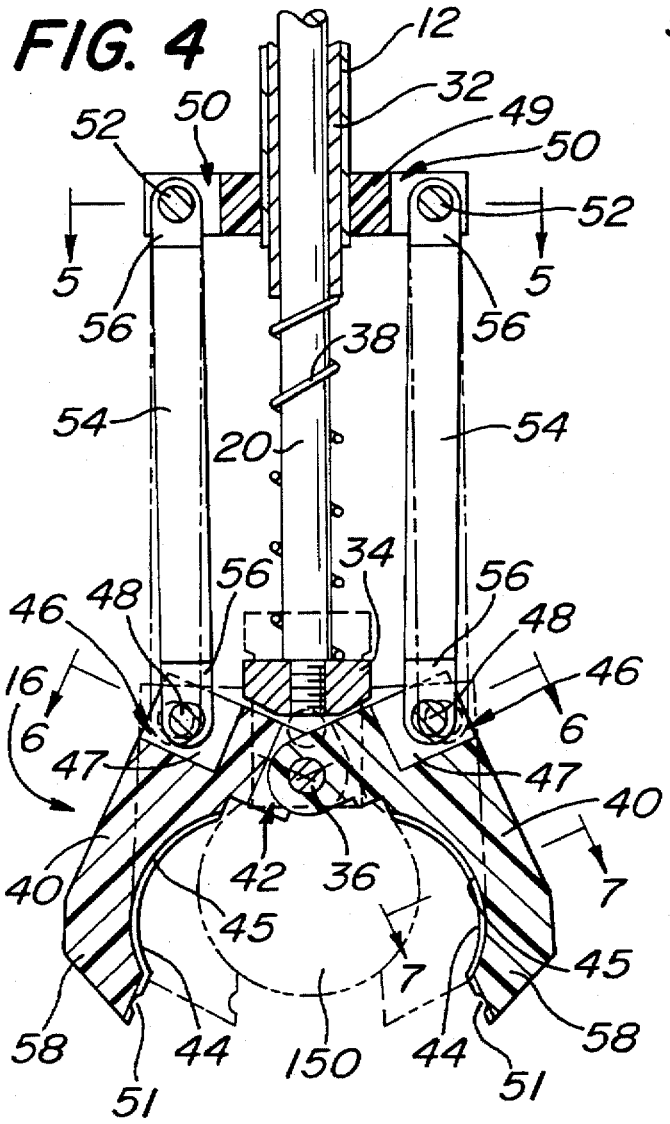
FIG. 4 is a cross-sectional view of the device taken along line 4—4 of FIG. 1.

As seen in FIG. 4, an annular bearing 32 is disposed at the end of the tubular shaft 12. The annular bearing 32 receives the inner rod 20, which extends outwardly therefrom, and permits rod 20 to move axially through bearing 32. A U-shaped bracket or clevis 34 is threadedly attached to the end of the inner rod 20. A pivot pin 36 extends between the legs of the clevis 34. A coil spring 38 is disposed on the inner rod 20 between the bearing 32 and the clevis 34 for biasing the inner rod 20 to the extended position shown in FIG. 4.

Figure 6:
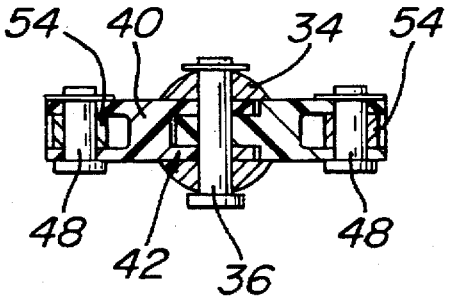
FIG. 6 is a cross-sectional view of the device taken along line 6—6 of FIG. 4.

As shown in FIGS. 4 and 6, a pair of coacting C-shaped jaws 40 are pivotably mounted on the pivot pin 36. An articulated pivot joint 42 connects the two jaw members 40 so that the pivot pin 36 can be received therein. The inner side 44 of each jaw 40 has an arcuate profile which conforms to the curvature of a golf ball 150 (shown in phantom) or similar object when the jaws 40 are closed. A slot or groove 46 is formed through a corner 47 of each jaw member 40 to form a mortise. A pivot pin 48 is provided in the corner 47 of each jaw member 40 and extends through the groove 46.

Figure 7:
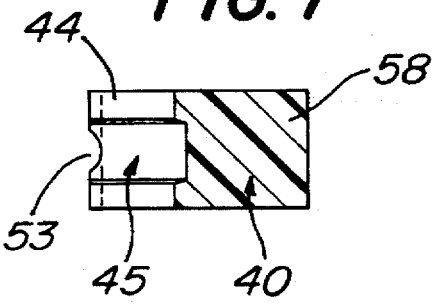
FIG. 7 is a cross-sectional view of the device taken along line 7—7 of FIG. 4.

As seen in FIGS. 4 and 7, a channel 45 is formed along the length of each inner side 44 to facilitate grasping of a golf ball 150 by the jaw members 40. In addition, a pair of transverse semi-circular grooves 51 and 53 are formed in the distal end 58 of each jaw and facilitate grasping of a golf tee or similar object. It is also contemplated that a golf ball or similar object can be grasped in the distal ends 58 of the jaws 40 if desired.

Figure 5:
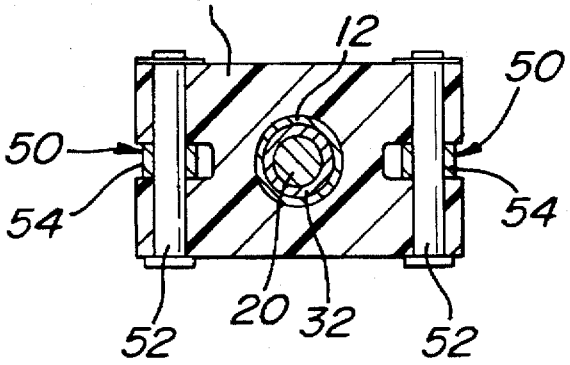
FIG. 5 is a cross-sectional view of the device taken along line 5—5 of FIG. 4.

As best seen in FIGS. 4 and 5, a support bracket 49 is fixedly mounted near the end of the tubular shaft 12 and extends outwardly therefrom. A transverse slot or groove 50 is formed in opposite ends of the support bracket 49. A pivot pin 52 is located at each end of the support bracket 49 and extends transversely through the support bracket 49, passing through the transverse slot 50.

A pair of control arms 54 connect each jaw member 40 to the support bracket 49. The end 56 of each control arm 54 is tenoned to fit within the slot 50 of the support bracket 49 and the slot 46 of one of the jaw members 40. One end 56 of each control arm 54 is pivotably attached to one of the pivot pins 52, while the other end 56 is pivotably attached to the pivot pin 48 in the respective jaw members 40. The control arms 54 define a pivot point at the outer corner 47 of each jaw member 40, permitting the jaw members 40 to open and close in response to axial displacement of the inner rod 20, as described below.

The gripper 16 operates as follows. Squeezing the trigger 22 against grip 14 displaces the slide member 24, drawing the inner actuating rod 20 into the tubular shaft 12 against the influence of the biasing spring 38. This displaces the clevis 34 to the position shown in phantom, causing the jaw members 40 to pivot about pivot pin 36. The jaw members 40 also pivot about pivot pins 48 via the control arms 54. The control arms 54 prevent the jaw members 40 from being displaced with the rod 20, but, instead force them to pivot about pins 48. This pivoting action around pivot pins 36 and 48 causes the jaw members to close. In this way, the jaw members 40 can be used to grasp a golf ball 150 (shown in phantom) or similar object within the grooved inner side walls 44 or distal ends 53 or a golf tee (not shown) or similar object within the semi-circular grooves 51 and 53.

Figure 8:
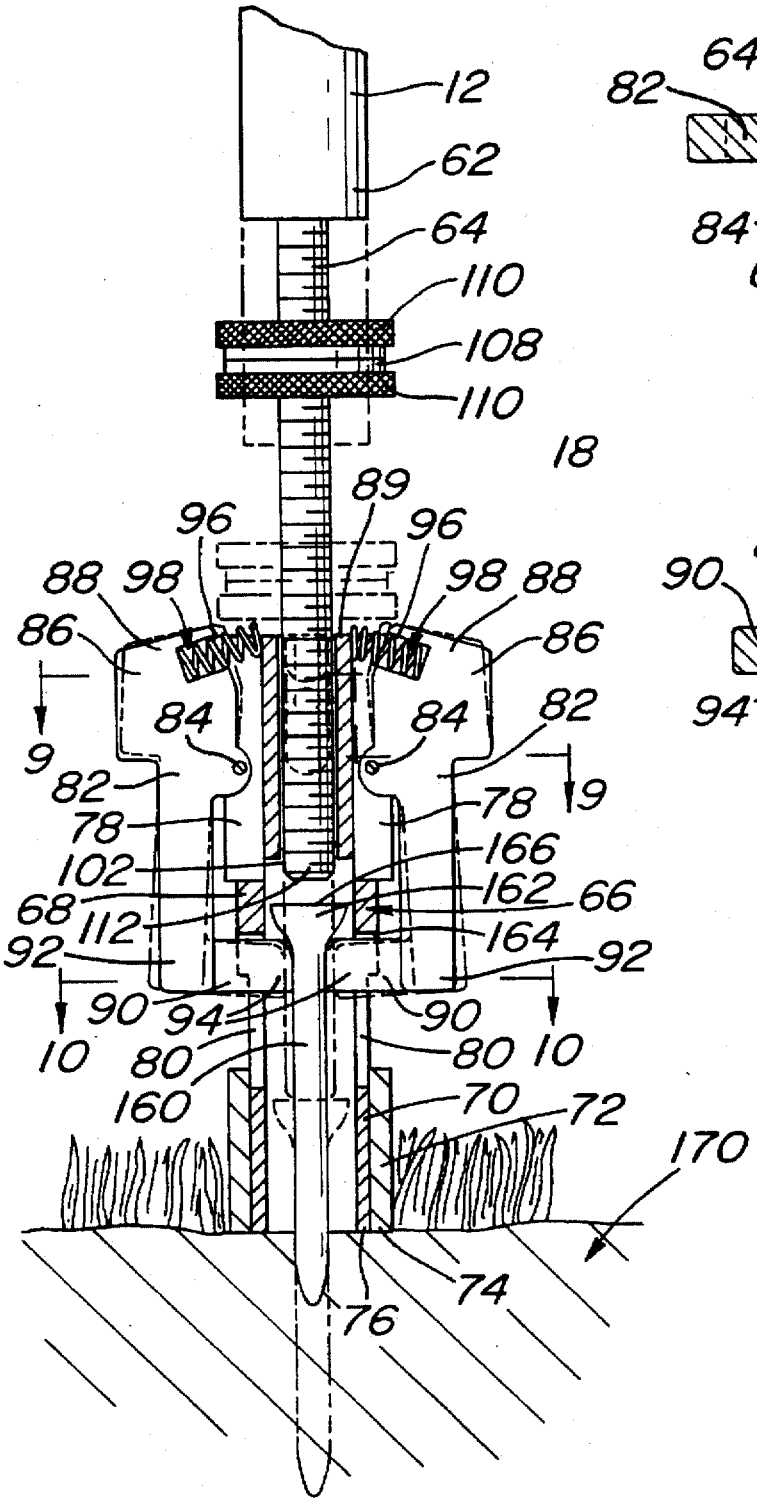
FIG. 8 is a cross-sectional view of the device taken along line 8—8 of FIG. 1.

Referring now to FIGS. 1 and 8, the tee inserter 18 includes a threaded rod 64 extending from the end 62 of the tubular shaft 12 opposite the gripper 16 end. A barrel 66 is slideably disposed on the threaded rod 64. The barrel 66 includes a main body portion 68 and a distal portion 70 having a reduced outer diameter. A tubular sleeve 72 is fixedly attached over the distal portion 70 of the barrel 66 so that the axial end 74 of the sleeve 72 is flush with the axial end 76 of the barrel 66. A pair of diametrically opposite longitudinal channels 78 are formed in the main body portion 68 of the barrel 66. A pair of diametrically opposite longitudinal slots 80 are formed in the distal portion 70 of the barrel 66 in alignment with the channels 78.

A pair of longitudinally extending jaws 82 are pivotably mounted within the channels 78 via a pivot pin 84 extending through the barrel 66. Each jaw member 82 includes a contact portion 86 formed on the upper end 88 of the jaw member 82 and extending outwardly therefrom.

Figure 10:
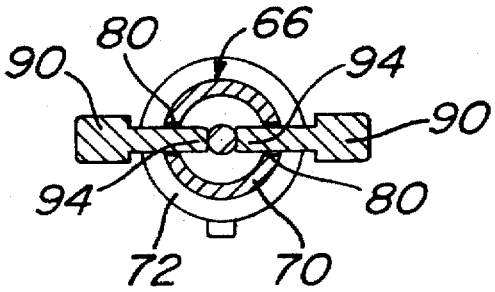
FIG. 10 is a cross-sectional view of the device taken along line 9—9 of FIG. 8.

As seen in FIGS. 8 and 10, each jaw member 82 also includes a transversely extending mandible portion 90 which extends inwardly from the lower end 92 of the jaw member 82 toward the tubular shaft 12, and fits within the slots 80 of the barrel 66. The distal ends 94 of the mandibles 90 are rounded so that the head 162 of a golf tee 160 can slide past mandibles 90 during insertion, as described below. A spring 96 is disposed within a bore 98 formed in the upper end 88 of each jaw member 82 for biasing the transversely extending mandibles 90 of each jaw member 82 into the slots 80.

Figure 9:
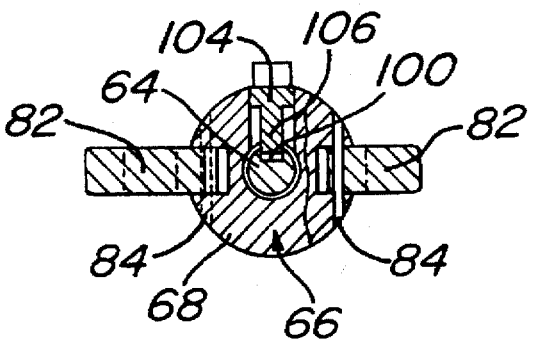
FIG. 9 is a cross-sectional view of the device taken along line 9—9 of FIG. 8.

As best seen in FIG. 9, a longitudinal groove 100 is formed along the length of the threaded rod 64. The groove 100 terminates before it reaches the distal end 102 of the threaded rod 64. A complementary key 104 is located on the barrel 66 and has a distal end 106 which fits within the groove 100 of the threaded rod 64. The key 104 and groove 100 cooperate to limit the barrel 66 from rotating on the threaded rod 64 when the barrel 66 is displaced relative to rod 64. The key 104 also prevents the barrel 66 from becoming disengaged from the threaded rod 64 when the barrel 66 reaches the distal end 102 of the rod 64, since the groove 100 does not extend all the way to the distal end 102.

An adjustable knob 108 is also provided on the threaded rod 64 for limiting the axial displacement of the barrel 66. The adjustment knob 108 includes knurled ring 110 and is threadedly connected to the threaded rod 64. The knurled adjustment knob 108 can be moved toward and away from the tubular shaft 12 by rotating the knob 108 on the threads of the threaded rod 64. The placement of the adjustable knob 108 on the threaded rod 64 determines the depth which the golf tee 160 is inserted in the ground 170, since contact of the knob 108 with the end wall 89 of the barrel 66 effectively limits the stroke of the rod 64 into the barrel 66.

The tee inserter 18 operates as follows. The barrel 66 is first moved to the distal end 102 of the threaded rod 64 as shown in FIG. 8. A tee 160 is loaded into the barrel 66 by squeezing the contact portions 86 of each jaw member 82. This pivots the jaw members 82 so that the transversely extending lower mandibles 90 move outwardly away from the centerline of the barrel 66 (shown in phantom in FIG. 8). This outward displacement of the mandibles 90 provides sufficient clearance so that the tee 160 can be inserted into the barrel 66 such that the head 162 of the tee 160 is positioned above the mandibles 90 within the barrel 66. In the event that the mandibles 90 are not pivoted sufficiently outwardly, the head 162 of the tee 160 can be forced to slide past the mandibles 90, since the distal end 94 of each mandible 90 is rounded.

When the tee 160 is properly positioned in barrel 66, the jaws 82 can be released, allowing the mandibles 90 to pivot inwardly into the barrel 66 under the influence of the springs 96. In this way, the mandibles 90 engage the tee 160 just below the shoulder portion 164 of the tee, retaining the tee 160 securely in the barrel 66.

Once the tee 160 is inserted into the barrel 66, the tee 160 is ready to be inserted into the ground 170 as follows. The adjustment knob 108 is set to the desired position depending on the depth that the tee 160 is desired to be inserted into the ground 170. To insert the tee 160, the end 76 of the barrel 66 is placed against the ground 170, and the tubular shaft 12 pressed downwardly. This forces the threaded rod 64 into the barrel 66 until the axial surface 112 of the distal end 102 engages the head 162 of the tee 160. As this happens, the axial surface 112 of the threaded rod 64 presses against the axial surface 166 of the head 162 of the tee 160. This forces the rounded shoulder 164 of the tee 160 against the rounded distal ends 94 of the mandibles 90, in turn forcing them open and pushing the tee 160 out of the barrel 66 against the spring tension of the jaws. The rod 64 continues to push the tee 160 out of the barrel 66 until the rod 64 reaches the end of its stroke, as determined by the position of the adjustment knob 108, automatically inserting the tee 160 into the ground 170 at the height determined by the setting of the adjustment knob 108.

Once the golf tee 108 is inserted into the ground 170, the gripper 16 can be used to place the ball 150 on the tee 160 or retrieve it therefrom.

FIGS. 11 and 12 show a spike member 114 which includes a spike 116 extending from a cylindrical end cap 118. The spike 116 includes a threaded portion 120 and the end cap includes a bayonet-type groove 122.

A bore 124 is formed through an end wall 126 of pistol grip 14 for receiving the spike 116. The bore 124 has a threaded portion 128 formed near the end of the bore, which cooperates with the threaded portion 120 of the spike 116 for securely retaining the spike 116 within the bore 124 for storage.

To use the spike member 114, it is unscrewed from the bore 124 and removed therefrom. The spike member 114 is then attached to the tubular sleeve 72 on the barrel 66 using the bayonet coupling, as shown in FIG. 12.

Bayonet bosses 130 extend outwardly from sidewalls of the sleeve 72 for cooperating with the bayonet grooves 122 on the end cap 118 for securing the spike member 114 thereto.

In this way the spike member 114 can be used to form a pilot hole in the ground 170 for the golf tee if the ground is frozen or hard or to support the device 10 in the ground 170 while playing.

The present invention may be embodied in other specific forms without departing from the spirit or essential attributes thereof and, accordingly, reference should be made to the appended claims, rather than to the foregoing specification, as indicating the scope of the invention.

What is claimed is:

1. A golf ball and tee positioning device, comprising:

an elongated shaft;

a gripper disposed at one end of the shaft for manipulating golf balls; and a tee inserter disposed at the other end of the shaft for inserting a tee into the ground, the inserter comprising an elongated rod extending from the other end of the shaft, a barrel slideably disposed on the rod for receiving a golf tee, a pair of jaws pivotably attached to the barrel, each jaw member having a mandible portion which extends into a slot formed in the barrel for engaging a tee located within the barrel and being spring biased into the tee engaging position.

2. The golf ball and tee positioning device according to claim 1, further comprising:

means for adjustably setting the stroke of the elongated rod within the barrel for changing the insertion depth of the tee into the ground.

3. The golf ball and tee positioning device according to claim 2, wherein the stroke adjusting means comprises a knob disposed on the elongated rod which coacts with an end wall of the barrel to limit the stroke of the elongated rod relative to the barrel, the knob being selectively positionable on the elongated rod.

4. The golf ball and tee positioning device according to claim 2, farther comprising:

an actuating rod slideably disposed within the shaft; an actuator connected to the shaft for displacing the actuating rod within the shaft; and a pair of gripping jaws pivotably mounted to a bracket disposed on the end of the actuating rod for grasping a spherical object in response to displacement of the actuating rod.

5. The golf ball and tee positioning device according to claim 4, wherein a control arm connects each gripping jaw member to the shaft such that displacing the actuating rod causes the gripping jaws to pivot between an opened and closed positions.

6. The golf ball and tee positioning device according to claim 5, wherein one end of each control arm is pivotably mounted to a support bracket on the shaft and an opposite end of each control arm is pivotably connected to a gripping jaw member.

7. The golf ball and tee positioning device according to claim 1, further comprising:

an actuating rod slideably disposed within the shaft; an actuator connected to the shaft for displacing the actuating rod within the shaft; and a pair of gripping jaws pivotably mounted to a bracket disposed on the end of the actuating rod for grasping a spherical object in response to displacement of the actuating rod.

8. The golf ball and tee positioning device according to claim 7, wherein a control arm connects each gripping jaw member to the shaft such that displacing the actuating rod causes the gripping jaws to pivot between opened and closed positions.

9. The golf ball and tee positioning device according to claim 8, wherein one end of each control arm is pivotably mounted to a support bracket on the shaft and an opposite end of each control arm is pivotably connected to a gripping jaw member.

10. The golf ball and tee positioning device according to claim 4, further comprising a pistol-type grip mounted to the shaft; the actuator being a trigger-type actuator disposed in proximity to the grip.

11. The golf ball and tee positioning device according to claim 1, further comprising a spike member replaceably mounted on the tee inserter.

12. A golf ball and tee positioning device, comprising:

an elongated shaft;

an actuating rod slideably disposed within the shaft;

an actuator connected to the shaft for displacing the rod within the shaft;

a gripper disposed at one end of the shaft for manipulating golf balls, the gripper including a pair of gripping jaws pivotably mounted to a bracket disposed on the end of the actuating rod for grasping a spherical object, and a control arm connecting each gripping jaw member to the shaft such that displacing the actuating rod causes the gripping jaws to pivot between opened and closed positions;

a tee inserter disposed at the other end of the shaft for inserting a tee into the ground, the inserter comprising an elongated rod extending from the other end of the shaft, a barrel slideably disposed on the elongated rod for receiving a golf tee, a pair of jaws pivotably attached to the barrel, each jaw member having a mandible portion which extends into a slot formed in the barrel for engaging a tee located within the barrel and being spring biased into the tee engaging position; and a knob disposed on the elongated rod which coacts with an end wall of the barrel to selectively limit the stroke of the elongated rod into the barrel, the knob being selectively positionable on the elongated rod for changing the insertion depth of the tee into the ground.

13. The golf ball and tee positioning device according to claim 12, wherein one end of each control arm is pivotably mounted to a support bracket on the shaft and an opposite end of each control arm is pivotably connected to a gripping jaw member.

14. The golf ball and tee positioning device according to claim 13, further comprising a pistol-type grip mounted to the shaft; the actuator being a trigger-type actuator disposed in proximity to the grip.

15. The golf ball and tee positioning device according to claim 14, further comprising a spike member replaceably mounted on the tee inserter.

* * * * *

UNITED STATES PATENT AND TRADEMARK OFFICE

CERTIFICATE OF CORRECTION

PATENT NO. : 5,669,646

DATED : Sept. 23, 1997

INVENTOR(S) : Emmanuel R. Fiocca, et al

It is certified that error appears in the above-identified patent and that said Letters Patent is hereby corrected as shown below:

On title page,

Delete --[73] Assignees: Emmanuel R. Fiocca, Drexel Hill; Bruce G. Greenfield, Bryn Mawr, both of Pa.--

Signed and Sealed this

Second Day of December, 1997

*Attest:*

*Attesting Officer*

BRUCE LEHMAN

*Commissioner of Patents and Trademarks*